United States Patent [19]

Robertson

[11] Patent Number: 5,017,407

[45] Date of Patent: May 21, 1991

[54] STABILISATION OF JET WIPED WIRE

[75] Inventor: Malcolm A. Robertson, East Maitland, Australia

[73] Assignee: Australian Wire Industries Pty. .Limited, Sydney, Australia

[21] Appl. No.: 392,077

[22] Filed: Aug. 10, 1989

[30] Foreign Application Priority Data

Aug. 24, 1988 [AU] Australia ..... PJ0030

[51] Int. Cl.[5] ..... B05D 3/04

[52] U.S. Cl. ..... 427/349; 427/398.3; 427/432; 427/433; 118/63; 118/420; 118/428; 118/DIG. 19

[58] Field of Search ..... 118/420, DIG. 19, 428, 118/63; 427/349, 398.3, 432, 433

[56] References Cited

U.S. PATENT DOCUMENTS

| | | | |
|---|---|---|---|
| 2,194,565 | 3/1940 | Moss | 15/269 |
| 3,060,889 | 10/1962 | Knapp | 118/63 |
| 3,270,364 | 9/1966 | Steele | 15/306 |
| 3,459,587 | 8/1969 | Hunter et al. | 117/102 |
| 3,533,761 | 10/1970 | Pierson | 29/191 |
| 3,611,986 | 10/1971 | Piersee | 118/63 |
| 3,707,400 | 12/1972 | Harvey et al. | 117/102 L |
| 3,736,174 | 5/1973 | Moyer | 117/102 M |
| 3,782,909 | 1/1974 | Cleary et al. | 427/349 |
| 4,207,362 | 6/1980 | Porter et al. | 427/433 X |
| 4,287,238 | 9/1981 | Starros | 427/349 |

FOREIGN PATENT DOCUMENTS

| | | |
|---|---|---|
| 421751 | 9/1970 | Australia . |
| 458892 | 8/1971 | Australia . |
| 462301 | 7/1973 | Australia . |
| 537944 | 10/1981 | Australia . |
| 539396 | 10/1981 | Australia . |
| 544277 | 10/1981 | Australia . |
| 1446861 | 8/1976 | United Kingdom . |
| 2010917 | 7/1979 | United Kingdom . |

*Primary Examiner*—Shrive Beck
*Assistant Examiner*—Alain Bashore
*Attorney, Agent, or Firm*—Poms, Smith, Lande & Rose

[57] ABSTRACT

The surface quality and luster of galvanized wire produced by the gas jet wiping method and cooled by jets of a cooling fluid may be improved by exposing the wire to a reactive gas atmosphere containing sulphide or chloride radicals after the wire has passed through the gas jet wiping nozzle and before it is contacted by the cooling fluid. The wire is exposed to the reactive gas atmosphere for a sufficient length of time to form a protective surface coating of metal sulphide or chloride.

12 Claims, 1 Drawing Sheet

STABILISATION OF JET WIPED WIRE

FIELD OF THE INVENTION

The present invention relates to a process for the stabilisation of a molten metallic coating on a metallic filament prior to cooling to produce a shiny lustre on the metal coating, and to means for bringing about this stabilisation.

BACKGROUND ART

It is known to coat metallic, normally ferrous, filaments such as wire or strip or sheet with molten metals such as zinc, aluminium and zinc/aluminium alloys. The filament is passed through a bath containing the coating metal in a molten condition. After leaving the bath a wiping force is applied to the filament to remove excess coating metal from its surface and to impart a smooth surface to the coating metal remaining on the filament.

It has been known to apply a mechanical wiping force to the filament by a number of methods. In one method wiping pads of asbestos or similar are used to physically wipe excess coating material from the surface. In a second method the filament is passed upwardly through a granular layer of materials such as charcoal, pebbles and glass beads with or without a lubricant such as oil or tallow, which layer floats on the surface of the molten metal bath. Another wiping method is gas jet wiping in which the filament passes through a stream of a suitable gas such as air, nitrogen or steam which applies a wiping force to the filament. Proposals have also been made to apply an electromagnetic wiping force to the filament.

The performance of the granular layer wiping method was improved by the injection of a reactive gas such as hydrogen sulphide into the granular layer in a process known as gas wiping and described more fully in Australian patent specification 421,751. In this process the primary purpose of the reactive gas is to form a layer of metal sulphide on the metal bath and within the granular layer to assist in the physical wiping of the excess metal from the filament.

It has subsequently been proposed to inject a reactive gas into a container, which surrounds the granular layer and at its lower end projects into the metal bath, at a level above the granular layer in order to improve the appearance of the wire (see British patent specification 1,446,861). In a later development it has been proposed to stabilise the surface of a molten metal coating on a filament being wiped by an electromagnetic force by injecting a reactive gas into a container which surrounds the electromagnetic device and which projects into the metal bath (see British patent specification 2,010,917). In each of these cases the reactive gas has been applied within a container positioned directly above, and in contact with the metal bath. This has both prevented the loss of reactive gas from the bottom of the container and has applied the reactive gas to the filament before there has been any possible oxidation of the coating metal.

After the filament has been coated and wiped, it is necessary to solidify the coating metal before it comes into contact with a solid object. Solidification of the coating metal is normally achieved by passing the filament through a cooling fluid, normally water and/or air. It has been found, in the gas jet wiping process, that it can be difficult to cool the filament without causing the resultant coating to have a rough surface. It has also been found that the solidified coating has a dull appearance; both of these characteristics are undesirable.

It has now been found that surprisingly beneficial results can be obtained by the application of a reactive gas to a filament that has been hot dipped and wiped by the gas jet wiping method. The advantages of the present invention are that it is possible to reduce, and in some cases eliminate, surface defects previously observed with gas jet wiped filaments cooled by the direct application of a cooling fluid, and to also give to the filament a relatively shiny lustre. It would not have been expected that the use as a reactive gas atmosphere would have been applicable to gas jet wiping. By its very nature in the gas jet wiping method the jet wiping nozzle is spaced from the metal bath. The container to hold the reactive gas must be positioned above the gas jet wiping nozzle and must have an aperture in its bottom to receive the filament. The process according to this invention thus involves the use of an effectively open bottomed gas container. The container will also be spaced sufficiently above the metal bath that some oxidation of the molten metal coating may occur prior to the wire being contacted by the reactive gas.

The present invention consists in a method for the coating of a metallic filament with a molten metal comprising the steps of drawing the filament from a molten metal bath, passing the filament through a gas jet wiping nozzle having a gas orifice spaced apart from the molten metal bath to direct a wiping gas stream against the filament to wipe excess molten metal from the filament, passing the wiped filament through a gas containment vessel containing a reactive gas atmosphere including sulphide or chloride radicals or materials which will decompose to produce such radicals, the containment vessel being spaced from the gas jet wiping nozzle sufficiently to allow the venting of wiping gas therebetween such that the reactive gas is not adversely diluted and the gas containment vessel being sufficiently long that the filament has a long enough residence time in the container to allow the reactive gas to react with the molten metal on the filament, and then cooling the filament by applying thereto a fluid coolant.

In another aspect the present invention consists in apparatus for the coating of a metallic filament with a molten metal comprising a molten metal bath, means to draw a filament from the molten metal bath, a gas jet wiping nozzle having a gas orifice spaced apart from the molten metal bath and adapted to direct a wiping gas stream against the filament to wipe excess molten metal from the filament, a gas containment vessel containing a reactive gas atmosphere which includes sulphide or chloride radicals or materials which will decompose to form such radicals, the containment vessel being spaced from the gas jet wiping nozzle sufficiently to allow the venting of wiping gas therebetween such that the reactive gas is not adversely diluted and the containment vessel being sufficiently long that a filament passing therethrough will have a residence time in the containment vessel long enough to allow the reactive gas to react with the molten metal on the filament, and cooling means adapted to apply a cooling fluid to a filament after it has emerged from the gas containment vessel.

The present invention enables filaments of acceptable surface quality to be produced over a wider range of conditions than has previously been possible with gas jet wiping. It has been found that, depending on the shape of the filament, the thickness of the coating metal and the flow rate of the cooling fluid, there is a speed of passage of the filament above which the degree of the filament's surface smoothness is unacceptable (which term is taken to mean that the roughness can be felt by scraping ones fingernail longitudinally along the filament) if the invention is not used. The flatter the filament is (i.e. the larger its radius of curvature), and consequently the greater the resistance offered to the flow of the cooling fluid, the slower the filament must be processed in order to achieve acceptable surface quality. Larger thicknesses of coating metal and higher flow rates of cooling fluid, also require slower process speeds in order to produce acceptable levels of surface smoothness. By way of example, it has been found that if a 4.00 mm diameter wire with a molten metal coating thickness of greater than 0.04 mm, is passed through a stream of water jets (each jet with a cross-sectional area of 2 $cm^2$ and flow rate of 6 liters/minute) the wire will have an unacceptable surface smoothness when processed at speeds above 0.8 m/s. For a 2.50 mm diameter wire under the same conditions the coating quality is unacceptable at speeds above 1.2 m/s. There is also a range of speeds up to this, in which the coating quality progressively deteriorates from being perfectly smooth to unacceptable.

The filament is preferably ferrous wire or rod however the process is also applicable to tubular products, strip products whether planar or shaped in cross-section and to sheet products. The coating metal is preferably zinc however other coating metals such as zinc alloys containing a majority of zinc may also be used.

The jet wiping nozzles for use in the present invention may be any one of the conventional jet wiping nozzles known, for example, from the following patent specifications:

U.S. Pat. No. 2,194,565;
U.S. Pat. No. 3,060,889;
U.S. Pat. No. 3,270,364;
U.S. Pat. No. 3,459,587;
U.S. Pat. No. 3,533,761;
U.S. Pat. No. 3,611,986;
U.S. Pat. No. 3,707,400;
U.S. Pat. No. 3,736,174;
Australian Pat. Nos.
458,892;
537,944;
539,396;
544,277;

It is preferred, however, to use the jet wiping nozzle the subject of the present applicant's copending Australian patent application No. PJ 0032 entitled "Improved Product and Process" the contents whereof are hereby incorporated in this specification by reference. The wiping gas may be an oxidising gas such as air or, preferably, a non-oxidising gas such as nitrogen.

The containment vessel should be spaced apart from the gas jet wiping nozzle sufficiently for that part of the wiping gas stream that flows in a direction away from the metal bath to be adequately vented between the nozzle and the containment vessel to such an extent that the reactive gas is not adversely diluted. If the two are too close together the wiping effect of the gas jet nozzle may be deleteriously affected and wiping gas entering the containment vessel through the aperture admitting wire into the vessel may adversely affect the formation of a stabilising film on the filament through dilution of the reactive gas. On the other hand some outward pressure from the wiping gas jet may prevent an undue flow of the reactive gas atmosphere out through the aperture which admits the filament into the vessel.

The cooling means may be any one of a number of known types wherein a stream of water or other liquid or a stream of a cooling gas is caused to contact the filament and its still molten coating. The preferred cooling means is that described in Australian Patent Specification 462,301 the contents whereof are incorporated herein by reference.

An air knife is preferably positioned between the reactive gas containment vessel and the cooling means to direct a stream of air across the wire. This air knife serves to prevent droplets of water from dropping into the molten metal bath or from running down the strand if for any reason it is necessary to stop the strand temporarily.

The reactive gas preferred is hydrogen sulfide however any gas that contains or provides the sulphide or chloride radical may be used. For example, chlorine, hydrogen chloride, diethyl disulfide, dipropyl disulfide, dimethyl disulfide, ethyl mercaptan, propyl mercaptan, carbon disulfide, methyl mercaptan and any similar gas.

The reactive gas atmosphere is preferably comprised of reactive gas in a combustible carrier gas such as natural gas, liquified petroleum gas, or propane. The use of such a combustible carrier which can be burnt as it passes out from the gas containment vessel is particularly useful when the reactive gas is hydrogen sulphide or a mercaptan as the sulphide containing material can be combusted together with the combustible gas.

The reactive gas is preferably present in the reactive gas atmosphere in concentration by volume of greater than 0.01%, more preferably 0.5% to 1.5%. The reactive gas containment vessel should be of sufficient length to allow reaction to take place between the reactive gas and the molten metal and to form a protective film on the molten wire. It has been found, for instance, that a containment vessel having a length of 15 cm is satisfactory for the galvanising of a 2.5 mm diameter steel wire at a speed of up to 1.5 m/s at a coating 300 $g/m^2$ and a hydrogen sulphide concentration of 0.5% by volume. If a larger diameter wire is to be treated or a faster speed or larger cooling mass is desired then a longer gas containment vessel is required.

BRIEF DESCRIPTION OF THE DRAWING

Hereinafter given by way of example only is a preferred embodiment of the invention described with reference to the accompanying drawing which shows a diagrammatic side elevational view of wire coating means according to the present invention.

PREFERRED EMBODIMENT

Figure 1:
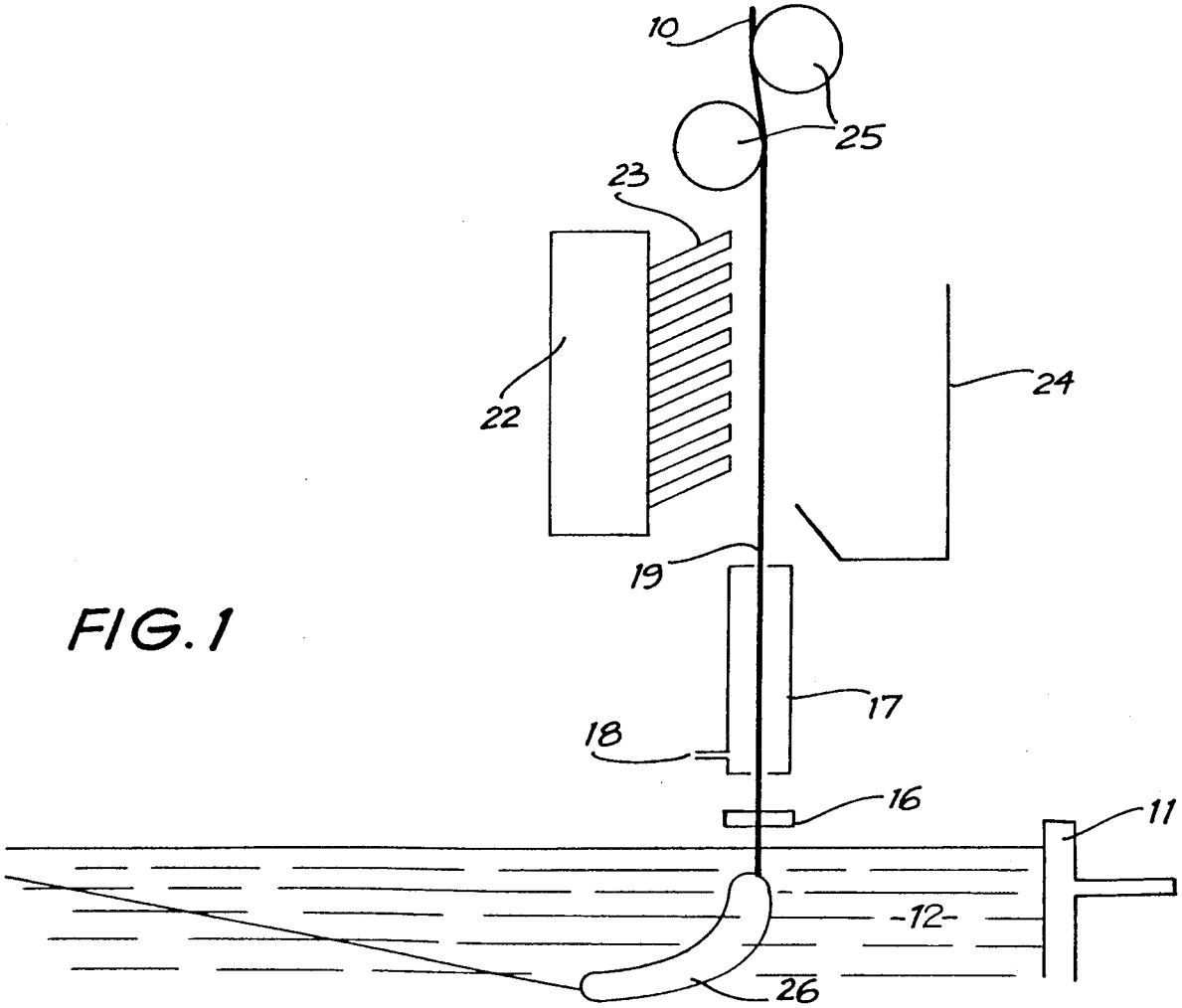

A steel wire 10 is passed through a bath 11 containing molten zinc 12, around a skid 26 and emerges travelling substantially vertically upwardly. The wire 10 passes through a jet wiping nozzle 16 which applies a wiping force to the wire 10 and strips excess molten zinc therefrom. The wire then passes into a tubular gas containment vessel 17 having apertures at its upper and lower ends of sufficient size to allow the passage of the wire therethrough without the wire contacting the sides of the apertures. A 1% concentration of hydrogen sulphide in natural gas is introduced into the lower end of the containment vessel 17 through an inlet 18.

The reactive gas stream emanates from the upper end 19 of the containment vessel 17 where it is burnt. The hydrogen sulphide in the reactive gas mixture causes the formation of a protective zinc sulphide film on the surface of the molten zinc coating.

The wire 10 then passes through a series of cooling water streams passing from a water source 22 having water spouts 23 into a water drain 24. The water streams issuing from spouts 23 cool the wire and its coating sufficiently to solidify the zinc such that its surface is not marred by its subsequent passage over rollers 25.

The wire 10 can be passed through the above apparatus at faster speeds and with thicker zinc coatings than with known means and still show a smooth shiny surface after being cooled. There is no evidence of surface blemish caused by impingement of the cooling water streams on the wire as is seen in the absence of the reactive gas treatment.

Table I shows the quality of the surface coating resulting from a variety of wire speeds and coating masses for 4.0 mm steel wire galvanised by dip coating in a zinc bath and wiped through a gas jet wiping nozzle as described in Australian Patent specification PJ 0032 which has a filament orifice of 10 mm, a gas orifice width of 0.70 mm and was positioned 15 mm above the surface of the zinc bath and cooled by direct contact by a water stream with a low water pressure. It can be seen that as the wire speed and the coating mass increase so the quality of the surface coating decreases. By contrast under all of the conditions shown in the table a smooth surface finish of high lustre was obtained when a 30 cm gas containment vessel containing natural gas and 0.5% hydrogen sulphide was positioned between the gas jet wiping nozzle and the cooling water stream.

TABLE I

| Wire Speed (m/s) | Coating Mass ($gm/m^2$) | Resulting surface quality |
|---|---|---|
| 0.4 | 227 | Slight frostiness |
| 0.4 | 307 | Frostiness |
| 0.4 | 331 | Frostiness |
| 0.4 | 348 | Orange peel |
| 0.5 | 176 | Slight frostiness |
| 0.5 | 259 | Slight frostiness |
| 0.5 | 282 | Frostiness |
| 0.5 | 309 | Frostiness |
| 0.5 | 348 | Orange peel |
| 0.6 | 215 | Slight frostiness |
| 0.6 | 258 | Slight frostiness |
| 0.6 | 315 | Frostiness |
| 0.6 | 334 | Orange peel |
| 0.6 | 393 | Orange peel |
| 0.7 | 217 | Slight frostiness |
| 0.7 | 262 | Orange peel |
| 0.7 | 320 | Orange peel |
| 0.7 | 348 | Ridges/unacceptable |
| 0.7 | 433 | Ridges/unacceptable |
| 0.8 | 219 | Slight frostiness |
| 0.8 | 292 | Frostiness |
| 0.8 | 311 | Ridges/unacceptable |
| 0.8 | 370 | Ridges/unacceptable |
| 0.8 | 423 | Ridges/unacceptable |
| 0.9 | 210 | Slight frostiness |
| 0.9 | 265 | Ridges/unacceptable |
| 0.9 | 305 | Ridges/unacceptable |
| 0.9 | 390 | Ridges/unacceptable |
| 0.9 | 417 | Ridges/unacceptable |
| 1.0 | 179 | Slight frostiness |
| 1.0 | 274 | Frostiness |
| 1.0 | 304 | Ridges/unacceptable |
| 1.0 | 361 | Ridges/unacceptable |
| 1.0 | 409 | Ridges/unacceptable |
| 1.5 | 252 | Ridges/unacceptable |
| 1.5 | 267 | Ridges/unacceptable |
| 1.5 | 341 | Ridges/unacceptable |

Table II shows the effect of varying hydrogen sulphide concentration on wire smoothness using the equipment outlined in respect of Table I except that the cooling water was applied under a higher pressure and the wire used was of 2.5 mm diameter.

TABLE II

| Wire Speed (m/s) | Coating Mass ($gm/m^2$) | % of $H_2S$ in Natural Gas Stream | Resulting surface quality |
|---|---|---|---|
| 1.3 | 417 | 0 | Ridges/unacceptable |
| 1.3 | 430 | .15 | Reasonably smooth |
| 1.3 | 408 | .3 | Reasonably smooth |
| 1.3 | 424 | .5 | Smooth |
| 1.3 | 425 | .5 | Smooth |
| 1.5 | 280 | 0 | Ridges/unacceptable |
| 1.5 | 287 | .15 | Smooth |
| 1.5 | 285 | .3 | Smooth |
| 1.5 | 282 | .5 | Smooth |

From the foregoing and from other similar experience it has been found that as the concentration of hydrogen sulphide increases there is an increase in surface quality up to an hydrogen sulphide concentration of 1.0% by volume for a give wire speed and chamber length.

What is claimed is:

1. A method for the coating of a metallic filament with a molten metal comprising the steps of drawing the filament from a molten metal bath, passing the filament through a gas jet wiping nozzle having a gas orifice spaced apart from the molten metal bath to direct a wiping gas stream against the filament to wipe excess molten metal from the filament, passing the wiped filament through a gas containment vessel containing a reactive gas atmosphere including sulphide or chloride radicals or materials which will decompose to produce such radicals, the containment vessel being spaced from the gas jet wiping nozzle sufficiently to allow the venting of wiping gas therebetween such that the reactive gas is not adversely diluted and the gas containment vessel being sufficiently long that the filament has a long enough residence time in the container to allow the reactive gas to react with the molten metal on the filament, and then cooling the filament by applying thereto a fluid coolant.

2. A method as claimed in claim 1 in which the filament is a ferrous wire and the molten metal is zinc or a zinc alloy containing a majority of zinc.

3. A method as claimed in claim 1 in which the reactive gas atmosphere contains a source of sulphide or chloride radicals selected from the group comprising hydrogen sulphide, chlorine, hydrogen chloride, ammonium chloride, diethyl disulphide, dipropyl disulphide, dimethyl disulphide, ethyl mercaptan, propyl mercaptan, carbon disulphide and methyl mercaptan.

4. A method as claimed in claim 1 in which the reactive gas atmosphere comprises a combustible carrier gas.

5. A method as claimed in claim 1 in which the source of sulphide of chloride radicals is present in the reactive gas atmosphere in a concentration of 0.5% to 1.5% by volume.

6. A method as claimed in claim 1 in which the filament is cooled by applying thereto water or another liquid coolant.

7. Apparatus for the coating of a metallic filament with a molten metal comprising a molten metal bath, means to draw a filament from the molten metal bath, a gas jet wiping nozzle having a gas orifice spaced apart from the molten metal bath and adapted to direct a wiping gas stream against the filament to wipe excess molten metal from the filament, a gas containment vessel having opposite first and second ends and containing a reactive gas atmosphere which includes sulphide or chloride radicals, the first end of the containment vessel being spaced from the gas jet wiping nozzle sufficiently to allow the venting of wiping gas therebetween such that the reactive gas is not adversely diluted and the containment vessel being sufficiently long that a filament passing therethrough will have a residence time in the containment vessel long enough to allow the reactive gas to react with the molten metal on the filament, and adjacent the second end, a cooling means adapted to apply a cooling fluid to a filament after it has emerged from the gas containment vessel.

8. Apparatus as claimed in claim 7 in which the containment vessel has a length of at least 15 cm, preferably 30 cm.

9. Apparatus as claimed in claim 7 in which the molten metal bath contains molten zinc or a zinc alloy containing a majority of zinc.

10. Apparatus as claimed in claim 7 in which the reactive gas atmosphere in the containment vessel contains a source of sulphide or chloride radicals selected from the group comprising hydrogen sulphide, chlorine, ammonium chloride, hydrogen chloride, diethyl disulphide, dipropyl disulphide, dimethyl disulphide, ethyl mercaptan, propyl mercaptan, carbon disulphide and methyl mercaptan.

11. Apparatus as claimed in claim 7 in which the cooling means comprises a jet of water.

12. A method as claimed in claim 4 in which the combustible carrier gas is selected from the group consisting of natural gas, liquified petroleum gas, and propane.

* * * * *